US008334810B2

(12) United States Patent
Foo

(10) Patent No.: US 8,334,810 B2
(45) Date of Patent: Dec. 18, 2012

(54) RESONANT CAP LOADED HIGH GAIN PATCH ANTENNA

(75) Inventor: Senglee Foo, Irvine, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 625 days.

(21) Appl. No.: 12/490,212

(22) Filed: Jun. 23, 2009

(65) Prior Publication Data

US 2009/0322642 A1 Dec. 31, 2009

Related U.S. Application Data

(60) Provisional application No. 61/133,147, filed on Jun. 25, 2008.

(51) Int. Cl.
*H01Q 1/38* (2006.01)

(52) U.S. Cl. ..... 343/700 MS; 343/893

(58) Field of Classification Search ..... 343/700 MS, 343/702, 816, 893
See application file for complete search history.

(56) References Cited

U.S. PATENT DOCUMENTS 5,661,494 A * 8/1997 Bondyopadhyay .... 343/700 MS
5,949,303 A 9/1999 Arvidsson et al.
6,788,661 B1 9/2004 Ylitalo et al.
7,084,815 B2 8/2006 Phillips et al.
7,099,686 B2 * 8/2006 Ro et al. ..... 455/550.1
7,196,674 B2 3/2007 Timofeev et al.
7,817,096 B2 10/2010 Linehan
2004/0090369 A1 * 5/2004 McCarrick ..... 343/700 MS
2007/0063791 A1 3/2007 Wu et al.
2007/0182634 A1 8/2007 Yamamoto et al.
2009/0021437 A1 1/2009 Foo
2009/0046017 A1 2/2009 Foo
2009/0074109 A1 3/2009 Foo
2009/0096702 A1 4/2009 Vassilakis et al.
2009/0278746 A1 * 11/2009 Aurinsalo et al. ..... 343/700 MS

OTHER PUBLICATIONS

International Search Report and Written Opinion pertaining to Application No. PCT/US2008/80050 dated Dec. 22, 2008.
Office Action dated Mar. 1, 2011 from U.S. Appl. No. 12/252,324.
Office Action dated Sep. 28, 2011 from U.S. Appl. No. 12/252,324.

* cited by examiner

*Primary Examiner* — Hoanganh Le
(74) *Attorney, Agent, or Firm* — OC Patent Law Group

(57) ABSTRACT

An antenna architecture containing a broadband resonant cap positioned over a radiating patch is disclosed. The resonant cap consists of a rectangular resonant patch at the center with parasitic patches in close proximity of the four edges of the resonant patch. The parasitic patches may be coplanar with the resonant patch or may be mounted at an angle with respect to the vertical axis of the resonant patch. The resonant cap reduces the HPBW of the emitted radiation and improves emission directivity.

16 Claims, 3 Drawing Sheets

RESONANT CAP LOADED HIGH GAIN PATCH ANTENNA

RELATED APPLICATION INFORMATION

The present application claims priority under 35 USC section 119(e) to U.S. provisional patent application Ser. No. 61/133,147 filed Jun. 25, 2008, the disclosure of which is incorporated herein by reference in its entirety.

BACKGROUND OF THE INVENTION

1. Field of the Invention

The present invention relates to radio communication antenna systems for wireless networks. More particularly, the invention is directed to high-gain radiating patch antennas and antenna arrays.

2. Description of the Prior Art and Related Background Information

Modern wireless antenna systems generally include a plurality of radiating elements that may be arranged over a ground plane defining a radiated (and received) signal beamwidth and azimuth angle. Antenna beamwidth has been conventionally defined by Half Power Beam Width ("HPBW") of the azimuth or elevation beam relative to a bore sight of such antenna element.

Real world applications often call for an antenna radiating element with frequency bandwidth, pattern beamwidth and polarization requirements that may not be possible for conventional antenna radiating element designs to achieve due to overall mechanical constraints.

Accordingly, a need exists for an improved antenna element architecture which allows optimization of antenna array requirements, such as HPBW, antenna gain, side lobe suppression, FIB ratio, etc., without introducing undesirable tradeoffs, while taking into account cost and complexity of such antenna structure.

SUMMARY OF THE INVENTION

In a first aspect, the present invention provides an antenna radiating structure comprising a generally planar radiating element, a ground plane configured below the generally planar radiating element, and a resonant cap. The resonant cap is configured above and spaced apart from the generally planar radiating element in a radiating direction. The resonant cap comprises a dielectric sheet, a conductive resonant patch configured on the dielectric sheet, and a plurality of conductive parasitic patches configured on the same or a different dielectric sheet. The plurality of parasitic patches are spaced from the resonant patch.

In an embodiment, the width and the length of the resonant patch are approximately one half of the wavelength of the radiation. The resonant patch is spaced approximately one half of the wavelength of the radiation above the ground plane. In an embodiment, the resonant patch is generally coplanar with the plurality of parasitic patches. In an embodiment, the plurality of parasitic patches are configured at an angle with respect to the plane of the resonant patch. The plane of the parasitic patches is preferably positioned at an angle with respect to the vertical axis of the resonant patch in the range of approximately 20 degrees to approximately 35 degrees. The plurality of parasitic patches may comprise a set of inner parasitic patches and a set of outer parasitic patches, wherein the inner parasitic patches are positioned adjacent to the edges of the resonant patch, and the outer parasitic patches are positioned adjacent to the outer edges of the inner parasitic patches. For example, the plurality of parasitic patches may comprise four inner parasitic patches and four outer parasitic patches. The length and width of the outer parasitic patches are preferably less than the length and width of the inner parasitic patches.

In another aspect, the present invention provides an antenna radiating structure comprising a first generally planar radiating element. The antenna radiating structure further comprises a ground plane configured below the first generally planar radiating element and a resonant cap configured above and spaced apart from the ground plane in a radiating direction. The resonant cap comprises a dielectric sheet, a rectangular resonant patch of conductive material configured on the dielectric sheet, and a plurality of parasitic patches of conductive material configured adjacent to the edges of the resonant patch.

In a preferred embodiment, the parasitic patch is adjacent to each edge of the resonant patch. The parasitic patches are preferably rectangular. In an embodiment, the resonant patch is generally coplanar with the plurality of parasitic patches. In a preferred embodiment, the dielectric sheet is configured to position the plurality of parasitic patches at an angle with respect to the vertical axis of the resonant patch. The plurality of parasitic patches are preferably positioned at an angle with respect to the vertical axis of the resonant patch in the range of approximately 20 degrees to approximately 35 degrees. The dielectric sheet is constructed from a material having a dielectric constant $E_r$ in a range of approximately 5.0 to approximately 10. The dielectric sheet is alternatively constructed from a material having a dielectric constant $E_r$ preferably in the range of approximately 4.6 and approximately 6. The plurality of parasitic patches preferably further comprises four outer parasitic patches positioned adjacent to the four outer edges of the inner parasitic patches. The length and width of the outer parasitic patches are preferably less than the length and width of the inner parasitic patches. and a second generally planar radiating element configured above and spaced apart from the first generally planar radiating element in a radiating direction. The antenna radiating structure may further comprise a second generally planar radiating element configured generally coplanar with the first generally planar radiating element and which has an aperture for radiative coupling thereto.

DETAILED DESCRIPTION OF THE INVENTION

It is an object of the present invention to enhance the directivity of a standard radiating patch antenna through the use of a broadband resonant cap above a radiating patch and a ground plane. In an embodiment of the present invention, the resonant cap comprises a dielectric sheet, a resonant patch formed on the dielectric sheet, and a plurality of parasitic patches surrounding the resonant patch. The parasitic patches may be coplanar or tilted at an angle with respect to the plane of the resonant patch. The gaps and lengths of the parasitic patches are preferably selected to allow appropriate amplitude weighting for sidelobe suppression.

In an embodiment of the invention, a resonant cap is positioned over a generally planar radiating element and a ground plane. The generally planar radiating element is disposed on a dielectric substrate, and the metallic ground plane is disposed on a ground plane dielectric substrate. The resonant cap, the generally planar radiating element, and the ground plane are mechanically coupled through the use of multiple spacers. Radio frequency (RF) energy from feed lines is coupled to the generally planar radiating element.

In another embodiment of the invention, a resonant cap is positioned over aperture-coupled antenna elements including a secondary radiating patch, a radiating patch, and a ground plane. Teachings related to the aperture-coupled antenna elements previously disclosed in patent entitled "Dual Polarization Antenna Element with Dielectric Bandwidth Compensation and Improved Cross-Coupling," filed Aug. 5, 2008, application Ser. No. 12/221,634 (Foo) may be employed herein and the disclosure of such patent is incorporated herein by reference. Also, plural patch antennas in accordance with the invention may be configured in an array on a common ground plane, such as disclosed in application Ser. No. 12/221,634, and such an improved array is disclosed herein by reference.

Reference will now be made to the accompanying drawings, which assist in illustrating the various pertinent features of the present invention.

Figure 1A:
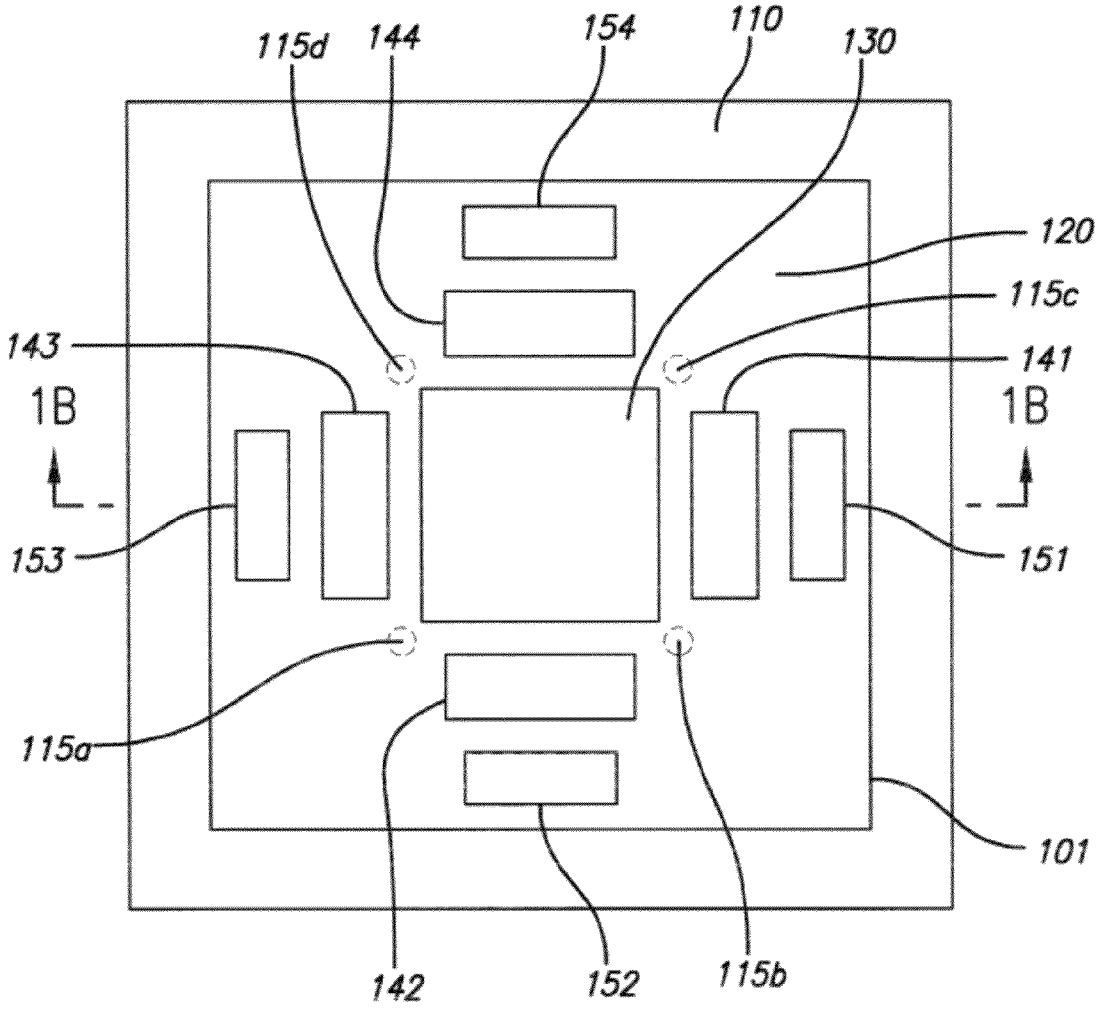
FIG. 1A is a top view of a high-gain patch antenna in an embodiment of the invention.
Figure 1B:
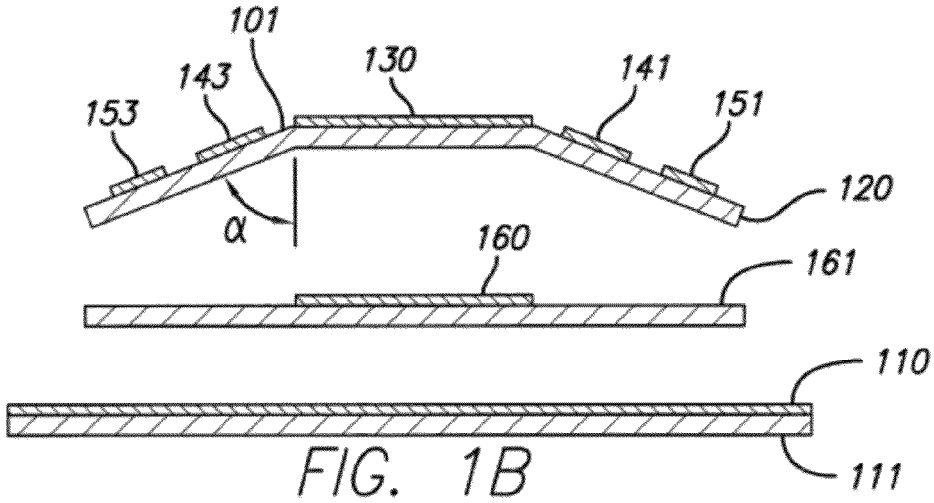
FIG. 1B is a cross section along the datum line depicted in FIG. 1A and presents a side view of a high-gain patch antenna in an embodiment of the invention.

FIGS. 1A and 1B illustrate an antenna architecture employing a resonant cap 101 employing a single radiating patch and ground plane. FIG. 1A presents a top view of resonant cap 101 over ground plane 110. FIG. 1B is a cross section along the datum line of FIG. 1A and illustrates resonant cap 101, radiating patch 160, and ground plane 110 in an embodiment of the invention.

The radiating patch 160 may be a conventional generally planar radiating element and is disposed on dielectric substrate 161. The metallic ground plane 110 is also conventional and is disposed on a ground plane dielectric substrate 111. The resonant cap, the generally planar radiating element, and the ground plane are mechanically coupled with spacers 115*a*-115*d* which provides the desired spacing. Radiating patch 160 is positioned above ground plane 110 at a distance in the range of approximately 10% to approximately 20% of the emission radiation wavelength. Radio frequency (RF) energy from feed lines (not shown) is coupled to radiating patch 160 in a conventional manner.

The resonant cap 101 may comprise a dielectric sheet 120 with the resonant patch 130, the inner parasitic patches 141-144, and the outer parasitic patches 151-154 on the surface of the dielectric sheet 120. Resonant patch 130 is positioned above the radiating patch 160 in a radiating direction spaced approximately one half of the emission wavelength above the ground plane. The length and width of resonant patch 130 are both approximately one half of the emission wavelength. The resonant patch 130, the inner parasitic patches 141-144, and the outer parasitic patches 151-154 may be constructed from metals such as copper, aluminum, or brass for example.

The dielectric sheet 120 may be fabricated out of low-loss dielectric materials with a dielectric constant $E_r$ above 5.0 and preferably between the range of approximately 5.0 and 10. In one or more embodiments of the invention, fibre glass materials with dielectric constants $E_r$ in the range of approximately 4.6 and 6.0 may be employed. Also, plastic materials may be employed. The dielectric sheet 120 may be used for low cost manufacturing of the resonant cap 101. In one or more embodiments of the invention, the thickness of the dielectric materials is minimized for reducing costs and lessening the impact of the dielectric sheet 101 on the radiation patterns. The thickness of the dielectric sheet may be in the range of approximately 0.25 millimeters to approximately 0.5 millimeters.

As depicted in FIG. 1B, the resonant cap 101 may comprise parasitic patches 141-144 and 151-154 that, in the view of FIG. 1B, are tilted with their plane at an angle $\alpha$ with respect to the vertical axis of the resonant patch 130 (i.e., the direction normal to the plane of the resonant patch 130). In an embodiment of the invention, tilt angle $\alpha$ typically may be in the range of approximately 20 degrees to approximately 35 degrees. The parasitic patches may be positioned at an angle with respect to the vertical axis of the resonant patch to control sidelobe emission. In an embodiment of the invention, resonant patch 130 may be coplanar with respect to the parasitic patches 141-144 and 151-154, i.e., $\alpha$ is approximately 90 degrees. Perspective views illustrating coplanar and tilted resonant caps 101 respectively are shown in FIGS. 2 and 3 in an alternate embodiment differing only in the radiating patch structure, which embodiments are discussed below.

The dimensions and positions of the inner parasitic patches 141-144 and the outer parasitic patches 151-154 determine the effective weight functions of the antenna aperture, and may be positioned to control radiating patterns, sidelobe levels, and frequency bandwidth. In the illustrative non-limiting implementations shown, the inner parasitic patches 141-144 are positioned adjacent to the edges of the resonant patch 130, and the outer parasitic patches 151-154 are positioned adjacent to the outer edges of the inner parasitic patches 141-144. However, it shall be understood that an alternate number, shape, or placement of the parasitic patches and/or type of radiating elements can be used as well.

In an embodiment, the dimensions of the outer parasitic patches 151-154 may be less than the corresponding dimensions of the inner parasitic patches 141-144. The dimensions and the positioning of the inner parasitic patches 141-144 and the outer parasitic patches 151-154 may be selected iteratively to achieve the desired antenna patterns. The antenna radiating structure may be adapted for operation within known bands, for example the UMTS band (1900-2200 MHz). The angle $\alpha$ and resonant cap 101 top and bottom height above the ground plane at the parasitic patch edges may be chosen to be approximately one half of the wavelength of the emitted radiation across the bandwidth in broad bandwidth applications.

Figure 2:
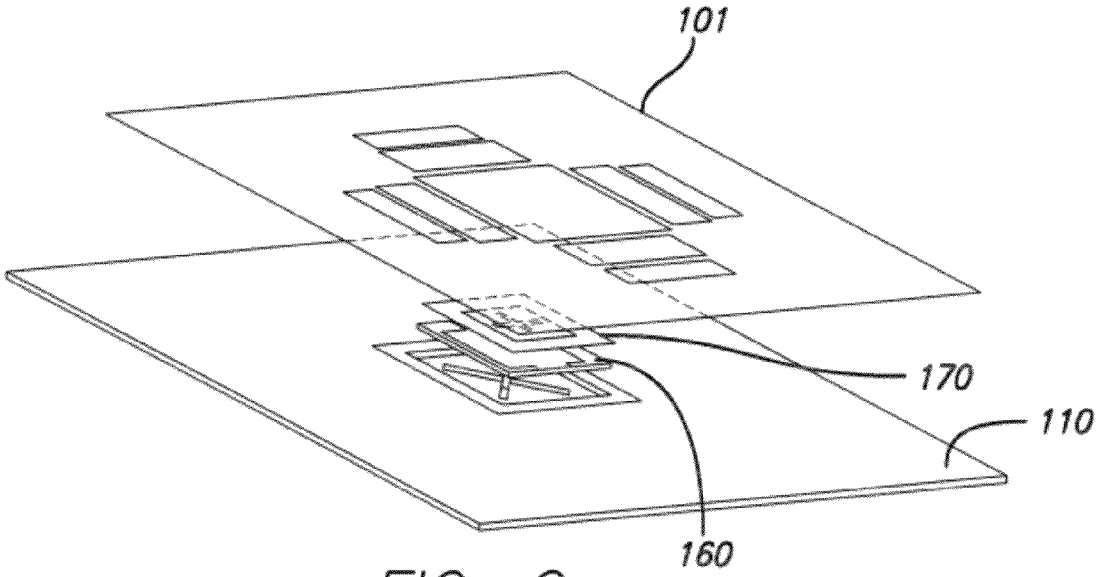
FIG. 2 depicts a high-gain patch antenna with coplanar resonant patch and parasitic patches in an embodiment of the invention.
Figure 3:
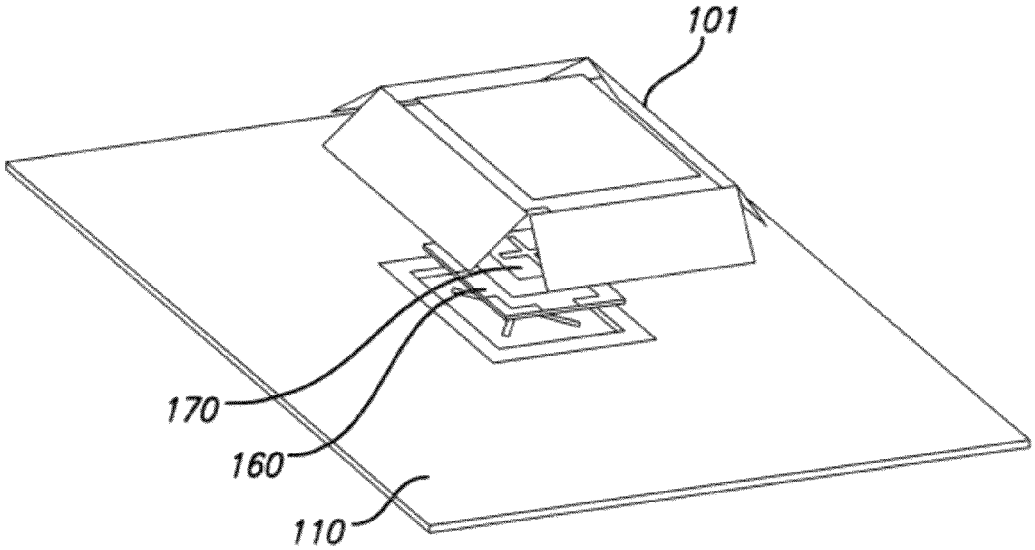
FIG. 3 depicts a high-gain patch antenna with the parasitic patches tilted at an angle with respect to the vertical axis of the resonant patch.

As depicted in FIGS. 2 and 3, resonant cap 101 may be positioned over alternate antenna radiating elements including a secondary radiating patch 170, a radiating patch 160, and a ground plane 110. Resonant cap 101 is positioned above the secondary radiating patch 170 in a radiating direction spaced approximately one half of the wavelength above the ground plane. The radiating patch 160 may be a generally planar radiating element. The secondary radiating patch 170 may be a second generally planar radiating element configured above and spaced apart from the first generally planar radiating element in a radiating direction and may be configured generally coplanar. The secondary radiating patch 170 may have an aperture for radiative coupling to the radiating patch 160. Ground plane 110 is positioned below the radiating patch 160. Resonant patch 130 is positioned above the secondary radiating patch 170 in a radiating direction spaced approximately one half of the wavelength above the ground plane. The resonant cap and the aperture-coupled antenna elements are mechanically coupled to the ground plane with spacers 115*a*-115*d* as in the embodiment of FIG. 1A (not shown in FIGS. 2 and 3).

Detailed discussion relating to the antenna elements including the secondary radiating patch 170, the radiating patch 160, and the ground plane 110 may be found in application Ser. No. 12/221,634 (Foo) which has been incorporated herein by reference.

Figure 4:
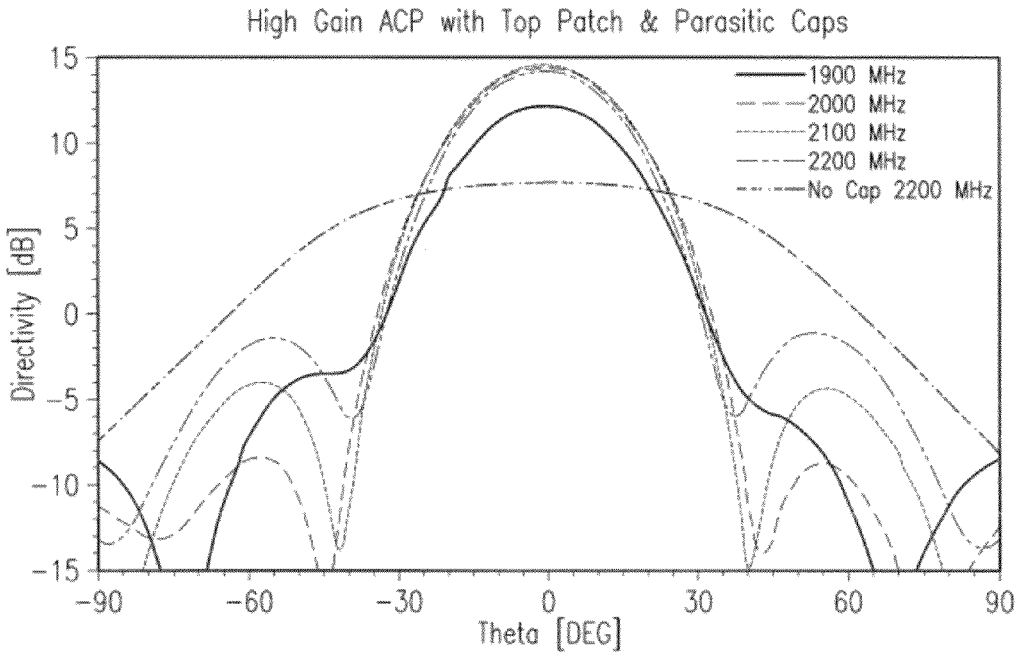
FIG. 4 is a representation of the simulated antenna radiation patterns for a resonant cap with coplanar resonant patch and parasitic patches employing an aperture-coupled patch.

As depicted in FIG. 2, resonant patch 130 may be coplanar with respect to the parasitic patches 141-144 and 151-154. The radiation patterns are presented in FIG. 4 for the high-gain resonant cap with coplanar resonant patch and parasitic patches in one or more embodiments of the invention. As depicted in FIG. 4, the resonant cap reduces the HPBW significantly and improves directivity by over 5 db.

Figure 5:
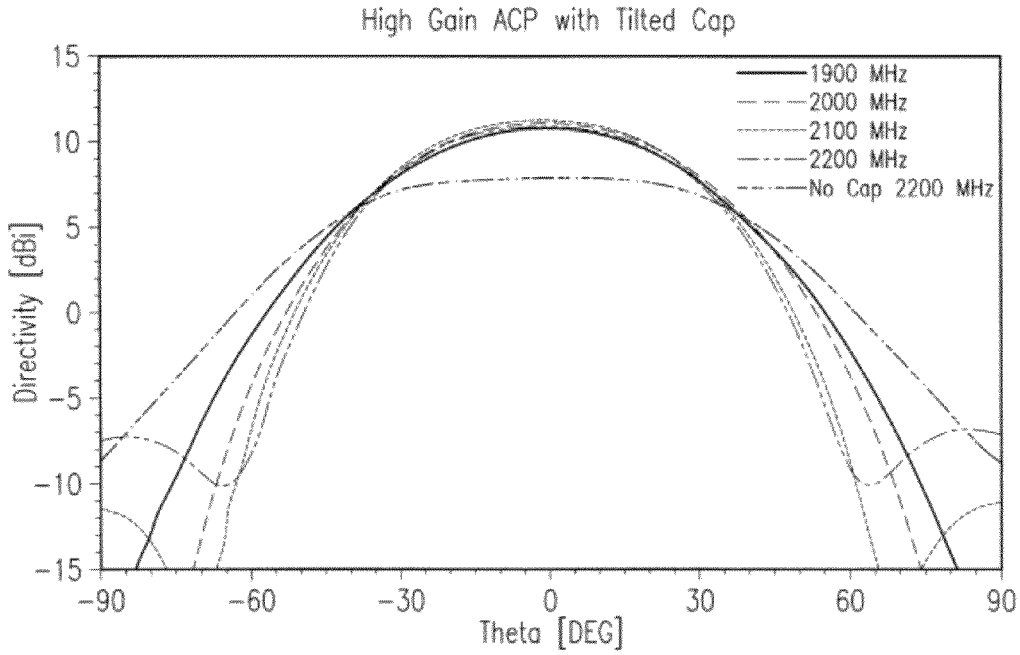
FIG. 5 is a representation of the simulated antenna radiation patterns for a resonant cap with tilted parasitic patches employing an aperture-coupled patch.

As depicted in FIG. 3, the resonant cap 101 may alternatively comprise parasitic patches 141-144 and 151-154 that are tilted with respect to the vertical axis of the resonant patch 130 to control sidelobe emission. In one or more embodiments of the invention, the tilt angle $\alpha$ may be typically in the range of approximately 20 degrees to approximately 35 degrees. FIG. 5 is a representation of the typical antenna radiation patterns for the high-gain resonant cap with the resonant patch and tilted parasitic patches in one or more embodiments of the invention. The resonant cap reduces the HPBW significantly and improves directivity.

The present invention has been described primarily for enhancing the directivity of a standard radiating patch through the use of a broadband resonant cap above a radiating patch and a ground plane. In this regard, the foregoing description of an antenna element based on the resonant cap is presented for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An antenna radiating structure, comprising:

a generally planar radiating element;

a ground plane configured below said generally planar radiating element; and, a resonant cap configured above and spaced apart from said generally planar radiating element in a radiating direction, said resonant cap comprising a dielectric sheet, a conductive resonant patch configured on said dielectric sheet, and a plurality of conductive parasitic patches configured on the same or different dielectric sheet, wherein said plurality of parasitic patches are spaced from said resonant patch;

wherein said plurality of parasitic patches are configured at an angle with respect to the plane of said resonant patch.

2. The antenna radiating structure as set out in claim 1, wherein the width and the length of said resonant patch are approximately one half of the wavelength of the radiation.

3. The antenna radiating structure as set out in claim 1, wherein said resonant patch is spaced approximately one half of the wavelength of the radiation above said ground plane.

4. The antenna radiating structure as set out in claim 1, wherein the planes of said parasitic patches are positioned at an angle with respect to the vertical axis of said resonant patch in the range of approximately 20 degrees to approximately 35 degrees.

5. The antenna radiating structure as set out in claim 1, wherein said plurality of parasitic patches further comprise a set of inner parasitic patches and a set of outer parasitic patches, wherein said inner parasitic patches are positioned adjacent to the edges of the resonant patch, and said outer parasitic patches are positioned adjacent to the outer edges of the inner parasitic patches.

6. The antenna radiating structure as set out in claim 5, wherein said plurality of parasitic patches comprise four inner parasitic patches and four outer parasitic patches.

7. The antenna radiating structure as set out in claim 5, wherein the length and width of the outer parasitic patches are less than the length and width of the inner parasitic patches.

8. An antenna radiating structure, comprising:

a first generally planar radiating element;

a ground plane configured below said first generally planar radiating element;

a resonant cap configured above and spaced apart from said ground plane in a radiating direction, said resonant cap comprising a dielectric sheet, a rectangular resonant patch of conductive material configured on said dielectric sheet, and a plurality of parasitic patches of conductive material configured adjacent to the edges of said resonant patch;

wherein said dielectric sheet is configured to position said plurality of parasitic patches at an angle with respect to the vertical axis of said resonant patch.

9. The antenna radiating structure as set out in claim 8, wherein at least one parasitic patch is adjacent to each edge of said resonant patch.

10. The antenna radiating structure as set out in claim 9, wherein said plurality of parasitic patches further comprise four outer parasitic patches positioned adjacent to the four outer edges of the inner parasitic patches.

11. The antenna radiating structure as set out in claim 10, wherein the length and width of the outer parasitic patches are less than the length and width of the inner parasitic patches.

12. The antenna radiating structure as set out in claim 8, wherein said parasitic patches are rectangular.

13. The antenna radiating structure as set out in claim 8, wherein said plurality of parasitic patches are positioned at an angle with respect to the vertical axis of said resonant patch in the range of approximately 20 degrees to approximately 35 degrees.

14. The antenna radiating structure as set out in claim 8, wherein said dielectric sheet is constructed from a material having a dielectric constant $E_r$ in a range of approximately 5.0 to approximately 10.

15. The antenna radiating structure as set out in claim 8, wherein said dielectric sheet is constructed from a material having a dielectric constant $E_r$ preferably in the range of approximately 4.6 and approximately 6.

16. The antenna radiating structure as set out in claim 8, further comprising a second generally planar radiating element configured above and spaced apart from said first generally planar radiating element in a radiating direction, said first and second generally planar radiating elements having generally parallel planar surfaces, said second generally planar radiating element having an aperture for radiative coupling to said first generally planar radiating element.

* * * * *